US011273561B2

(12) United States Patent
Tomassetti

(10) Patent No.: US 11,273,561 B2
(45) Date of Patent: Mar. 15, 2022

(54) RAZOR WITH HEATED AND VIBRATING BLADES

(71) Applicant: Louis D. Tomassetti, Pompano Beach, FL (US)

(72) Inventor: Louis D. Tomassetti, Pompano Beach, FL (US)

(73) Assignee: HEATED BLADES HOLDING COMPANY, LLC, Pompano Beach, FL (US)

( * ) Notice: Subject to any disclaimer, the term of this patent is extended or adjusted under 35 U.S.C. 154(b) by 0 days.

(21) Appl. No.: 16/889,461

(22) Filed: Jun. 1, 2020

(65) Prior Publication Data

US 2020/0376696 A1 Dec. 3, 2020

Related U.S. Application Data

(60) Provisional application No. 62/854,632, filed on May 30, 2019.

(51) Int. Cl.
*B26B 19/38* (2006.01)

(52) U.S. Cl.
CPC ..... *B26B 19/3873* (2013.01)

(58) Field of Classification Search
CPC ..... B26B 19/3873; B26B 21/48; B26B 21/58; B26B 21/222; B26B 21/0475; B26B 21/4056; B26B 21/405; B26B 21/4081; B26B 21/38; Y10T 83/04
USPC ..... 83/13; 30/34.05, 140, 538, 45, 44, 42, 30/43.6
See application file for complete search history.

(56) References Cited

U.S. PATENT DOCUMENTS

| | | | | |
|---|---|---|---|---|
| 6,817,101 | B1 * | 11/2004 | Bohmer | B26B 21/48 30/140 |
| 8,479,624 | B2 * | 7/2013 | Flyash | A61B 18/082 83/13 |
| 2006/0070242 | A1 * | 4/2006 | Szczepanowski | B26B 21/48 30/140 |
| 2009/0071008 | A1 * | 3/2009 | Hart | B26B 21/4087 30/34.05 |
| 2009/0255123 | A1 * | 10/2009 | Tomassetti | B26B 21/48 30/34.05 |
| 2013/0312579 | A1 * | 11/2013 | Childers | B26B 21/4081 83/13 |
| 2015/0135538 | A1 * | 5/2015 | Tomassetti | B26B 21/48 30/45 |

* cited by examiner

*Primary Examiner* — Ghassem Alie
(74) *Attorney, Agent, or Firm* — Malloy & Malloy, P.L.; Robert M. Downey

(57) ABSTRACT

A blade cartridge for a wet shave razor includes multiple blades that are electrically connected in series to a power source, such as a battery power source, wherein the blades are heated as a result of electrical resistance created by the electric current flow through the blades. The electric current flow through the blades creates a magnetic field around each of the blades, which is opposite in polarity to adjacent blades due to the blades being electrically connected in series, wherein current flow is in opposite direction in each adjacently positioned blade. A method of vibrating the blades includes the step of rapidly alternating direction of current flow to change the polarity of electric fields around each blade to cause momentary attraction between adjacent blades in rapid impulses (e.g., 700 hz to 75 khz) that results in vibration of the blades.

2 Claims, 1 Drawing Sheet

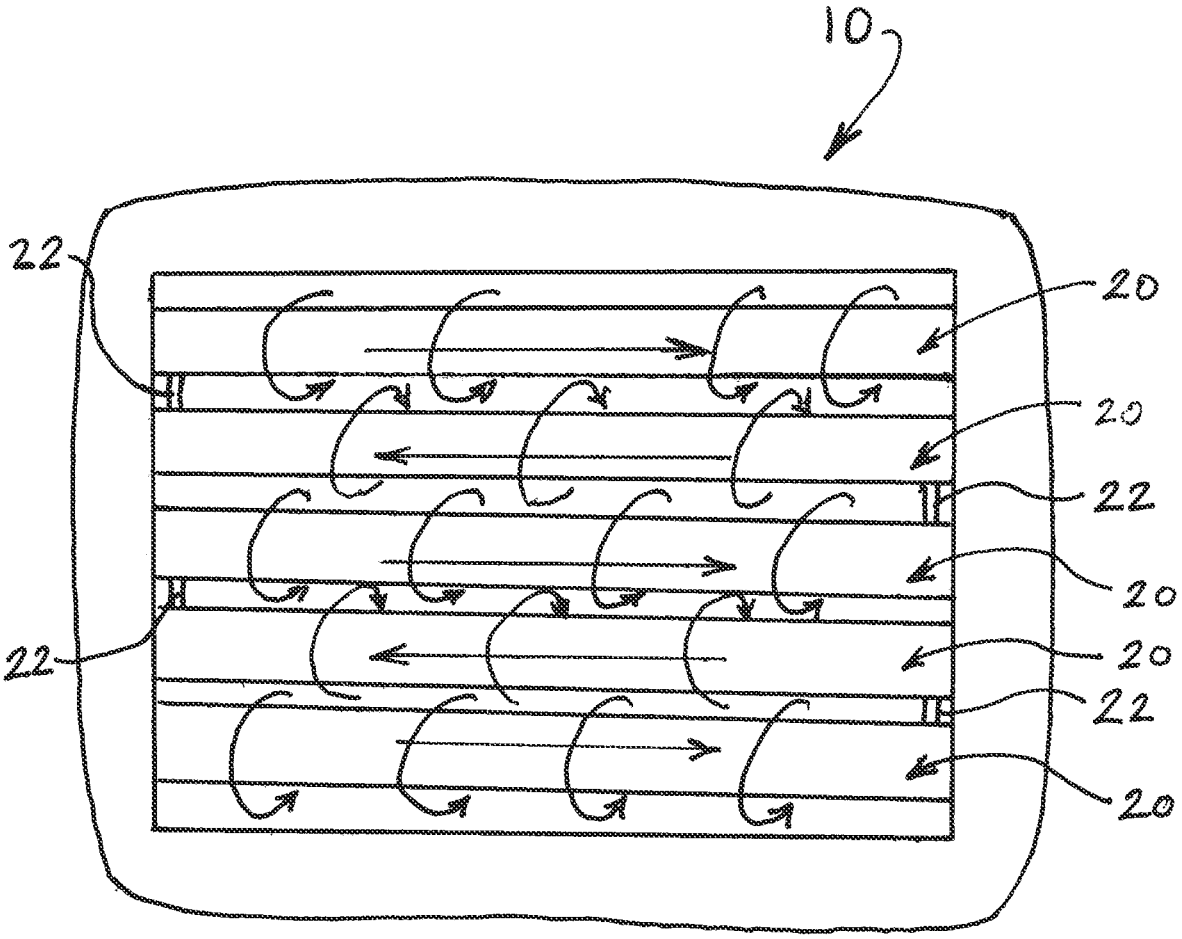
10
22
20
20
22
20
22
20
22
20

RAZOR WITH HEATED AND VIBRATING BLADES

This non-provisional patent application is based on provisional patent application Ser. No. 62/854,632 filed on May 30, 2019.

BACKGROUND OF THE INVENTION

Field of the Invention

The present invention relates to wet shave razors, and more particularly, to a wet shave razor that uses current flow through the blades to heat the blades while simultaneously vibrating the blades.

Discussion of the Related Art

Wet shave razors are used by millions of men and women every day. Most wet shave razors include a handle and a razor head with multiple metal (e.g., steel) blades supported in the razor head in parallel, equally spaced arrangement so that the cutting edges of the blades are optimally angled to cut hairs when moving the razor head along the skin surface without cutting into the user's skin. Many wet shave razors from different manufacturers allow for easy removal and replacement of the razor head. In this instance, the razor heads are manufactured in the form of replaceable blade cartridges, each having a plastic frame that holds the multiple blades in the correct parallel, equally spaced arrangement. Various shave products, such as shave cream, shave gel and special soaps are available to help promote smooth movement of the blades against the skin surface without cutting or nicking the skin. Many blade cartridges now include a strip of lubricating material to promote gliding of the blade cartridge over the skin surface in a manner that helps to prevent nicks and cuts.

For consumers, two of the most important features of wet shave razors are cutting performance and comfort. Naturally, when a person shaves, they want their skin to be left smooth and free of stubble, and preferably in one shaving stroke without having to go over the same area multiple times in order to achieve a clean shave. This requires a razor to have excellent cutting performance. And, when a person shaves, they want to enjoy the process. The feeling of the blade cartridge moving along the skin surface needs to be comfortable and soothing.

An excellent way to improve the cutting performance and comfort of a wet shave razor would be to vibrate the multiple blades in the blade cartridge. The vibrating action of the blades would enhance the cutting performance of the blades and, at the same time, the feeling of vibration against the user's skin would provide for a more pleasant and comfortable shaving experience. Currently, there are vibrating wet shave razors in the related art and available on the market for purchase by consumers. These vibrating wet shave razors include a battery power source and a miniature electric motor in the handle of the razor that causes the handle and blade cartridge to vibrate when the motor is energized by operation of a switch on the handle. While the vibrating action of the handle and the blade cartridge may feel comfortable to the user, the feeling of the actual blades vibrating is illusory to some extent. This is because the blades are not being directly vibrated. Instead, the handle is vibrated which transmits a feeling of vibration to the blade cartridge. Improving the cutting performance of the blades through vibration requires that the blades themselves be directly vibrated. Accordingly, there is a need for an improved wet shave razor that provides for enhanced cutting performance of the blades, while simultaneously providing greater comfort to the user when shaving. More particularly, there remains an urgent need for a wet shave razor that directly vibrates the multiple blades in the blade cartridge to increase the cutting performance of the blades, while also providing a comfortable and pleasant feeling as the blade cartridge is moved along the user's skin. Moreover, there is an urgent need for a wet shave razor that provides for vibration of the blades by directing electric current through the blades while simultaneously warming the blades for added comfort to the user.

SUMMARY OF THE INVENTION

The present invention is directed to a method of vibrating and heating blades in a wet shave razor that includes a handle and a blade cartridge pivotally connected to the handle. The blade cartridge includes multiple blades that are electrically connected in series to a power source, such as a battery power source in the handle of the razor, wherein the blades are heated as a result of electrical resistance created by the electric current flow through the blades. The electric current flow through the blades creates a magnetic field around each of the blades, which is opposite in polarity due to the blades being electrically connected in series, wherein current flow is in opposite direction in each adjacently positioned blade. The method includes the step of rapidly alternating direction of current flow through the blades to change the polarity of electric fields around each blade to cause momentary attraction between adjacent blades in rapid impulses (e.g., 700 hz to 75 khz) that results in vibration of the blades.

BRIEF DESCRIPTION OF THE DRAWING

For a fuller understanding of the nature of the present invention, reference should be made to the following detailed description taken in conjunction with the accompanying drawing in which:

FIG. 1 is a general schematic diagram of a blade cartridge for a razor and illustrating a direction of current flow through the blades and a magnetic field created around each of the blades.

Like reference numerals refer to like parts in the drawing.

DETAILED DESCRIPTION OF THE PREFERRED EMBODIMENTS

A wet shave razor includes a handle and a blade cartridge that is pivotally connected to the handle. The blade cartridge may be made to be detachable from the handle by the user to allow for replacement of new blade cartridges as needed when the cutting-edge blades of the razor are dulled.

The blade cartridge is shown schematically in FIG. 1, generally indicated as 10, and contains multiple metal (steel) blades 20 that are arranged in parallel, spaced relation to one another. In one embodiment, the blade cartridge 10 contains five blades 20. The blades 20 are electrically connected in series, as indicated by 22 in FIG. 1, for receiving an electric current from a power source, such as a battery power source. The battery source may be contained in the handle of the razor or on the blade cartridge. In one embodiment, the battery power source is contained in the handle of the razor and may be a rechargeable battery power source. Upon operation of a switch, to close the electrical circuit connecting the blades to the battery power source, electric current is directed through the blades 20 as indicated by the directional arrows in FIG. 1, which causes the blades 20 to increase in temperature due to the electrical resistance of the blades. More specifically, as electric current flows through the blades 20, the electrical resistance of the blades 20 creates heat that causes the blades to be warmed.

As current flows through the blades 20 in the blade cartridge 10 as shown by the directional arrows, a magnetic field is created around each blade as indicated by the circular arrows around each blade. Because the blades 20 are connected in series, the direction of current flow in adjacently positioned blades is in opposite directions. Applying the right-hand rule for electromagnetic fields, the magnetic field around each blade is easily determined. By holding the thumb of the right hand in the direction of the flow of current in each blade, the magnetic field that goes around each of the blades is in the direction of the four fingers. Then, if the north pole is negative, for example, and the south pole is positive, the north pole and the south pole will attract each other. Thus, if the north pole of the electromagnetic field is on one side of a blade, and the south pole of the electromagnetic field is on the opposing side of the adjacent blade, there is an attraction between adjacent blades. Thus, when electric current is passed through the blades 20 of the razor, because the blades 20 are connected in series, they generate a magnetic field of opposite polarities and they will attract. When the polarity is reversed, the blades 20 will initially spring back away from each other and then they are subsequently attracted to one another again resulting in vibration of the blades. More specifically, the moment that current through the blades 20 is reversed, initially there is an induction effect which will reverse the current and flip the electromagnetic poles of the blades 20. The current flow is initially in the same direction so they will repel each other and then quickly they will attract each other again. Thus, reversing the current flow constantly, and in rapid impulses (e.g., 700 hz to 75 khz), causes vibration of the blades 20.

Then, by varying the speed and intensity of the actual voltage of the current passing through the blades, the amplitude and frequency of vibrations can be controlled. The result is an improvement of the cutting properties of the blades 20. In particular, when the blades vibrate, they make multiple cuts in one stroke.

In another embodiment, a permanent magnet is fixed on the back of each of the blades 20. This results in a magnetic field around each of the blades. Thus, because there is already a magnetic field around each of the blades 20 created by the permanent magnets attached to the back of the blades 20, the amount of EM (electromagnetic) field that is required to move the blades is significantly less than without the use of permanent magnets. With the permanent magnets attached to the back of each of the blades, less current is required to achieve the same amount of motion (i.e., vibration), thereby reducing power consumption and extending the life of the battery power source. In a further embodiment, the permanent magnets are replaced with an electromagnet which is able to control two degrees of motion. Specifically, use of an electromagnet allows for control of the motion of the blades 20 against one another, as well as control of the motion against the electromagnet by modulating the currents. With the use of electromagnets, the amount of magnetic force is significantly greater than the first embodiment wherein the electric current flow creates an electromagnetic field around the blades alone. Use of the electromagnet allows for the creation of more amplitude and thus the amount of magnetic force that the electromagnet generates as well as the direction of the electromagnetic field.

While the present invention has been shown in accordance with several preferred and practical embodiments, it is recognized that departures from the instant disclosure are fully contemplated within the spirit and scope of the present invention which is not to be limited except as defined in the following claims as interpreted under the Doctrine of Equivalents.

What is claimed is:

1. A method for heating and vibrating blades in a razor for shaving, the method comprising the steps of:

providing a blade cartridge having a plurality of blades electrically connected to each other in series;

directing an electric current through the plurality of blades;

causing the blades to be heated as a result of an electrical resistance to the current flow through the blades;

creating a magnetic field around each of the blades, and wherein the magnetic field around each blade is opposite in polarity to the electric field around a next adjacent blade causing the adjacent blades to be attracted to one another; and continuously reversing the direction of current flow through the plurality of blades in impulses of between 700 hz and 75 khz, causing the adjacently positioned blades to momentarily attract and then spring back between impulses and thereby resulting in vibration of the plurality of blades.

2. The method as recited in claim 1 further comprising the steps of:

continuously reversing the current flow through each of the plurality of blades in impulses; and causing the adjacently positioned blades to initially repel each other and then subsequently attract to one another with each reversed impulse of current flow and thereby resulting in vibration of the plurality of blades.

* * * * *